US011175063B2

(12) United States Patent
Zhong et al.

(10) Patent No.: US 11,175,063 B2
(45) **Date of Patent: *Nov. 16, 2021**

(54) SWITCHING DEVICE FOR MULTI-SPLIT AIR CONDITIONER AND MULTI-SPLIT AIR CONDITIONER HAVING SAME

(71) Applicants: GD MIDEA HEATING & VENTILATING EQUIPMENT CO., LTD., Foshan (CN); MIDEA GROUP CO., LTD., Foshan (CN)

(72) Inventors: Rujiang Zhong, Foshan (CN); Zibao Zhuang, Foshan (CN); Wenjie Zhou, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 303 days.

This patent is subject to a terminal disclaimer.

(21) Appl. No.: 16/282,037

(22) Filed: Feb. 21, 2019

(65) Prior Publication Data

US 2019/0186772 A1 Jun. 20, 2019

Related U.S. Application Data

(63) Continuation of application No. PCT/CN2017/084972, filed on May 18, 2017.

(30) Foreign Application Priority Data

Aug. 23, 2016 (CN) ..... 201610709381.X
Aug. 23, 2016 (CN) ..... 201620925793.2

(51) Int. Cl.
*F24F 11/72* (2018.01)
*F24F 11/84* (2018.01)
(Continued)

(52) U.S. Cl.
CPC ..... *F24F 11/72* (2018.01); *F24F 1/32* (2013.01); *F24F 1/34* (2013.01); *F24F 1/36* (2013.01);
(Continued)

(58) Field of Classification Search
CPC ..... F24F 11/72; F24F 1/32; F24F 1/40; F24F 1/34; F24F 1/36; F24F 11/84; F24F 13/20;
(Continued)

(56) References Cited

U.S. PATENT DOCUMENTS 4,614,090 A * 9/1986 Kaneko ..... F25B 13/00 62/158
5,937,663 A * 8/1999 Chen ..... F28D 20/0039 62/238.7
(Continued)

FOREIGN PATENT DOCUMENTS

CN 2797956 Y 7/2006
CN 1952532 A 4/2007
(Continued)

OTHER PUBLICATIONS

GD Midea Heating & Ventilating Equipment Co. Ltd. et al., Requisition by Examiner, CA3034567, dated Jan. 29, 2020, 4 pgs.
(Continued)

*Primary Examiner* — Eric S Ruppert
*Assistant Examiner* — Kirstin U Oswald
(74) *Attorney, Agent, or Firm* — Morgan, Lewis & Bockius LLP

(57) ABSTRACT

A switching device for a multi-split air conditioner and a multi-split air conditioner having same. The switching device has a base, a drain tank, multiple damping pads, and multiple fixing members. The base has a bottom wall and side walls, the side walls surrounding the bottom wall and
(Continued)

extending upward from the edge of the bottom wall. The drain tank is disposed in the base, and the bottom surface of the drain tank is vertically spaced apart from the bottom wall of the base. The multiple damping pads are disposed on the drain tank and arranged at intervals in the circumferential direction of the drain tank. The multiple fixing members are respectively disposed on the damping pads and are connected to the side walls of the base. The multiple fixing members are all spaced apart from the drain tank.

12 Claims, 7 Drawing Sheets

(51) Int. Cl.

| | |
|---|---|
| ***F24F 13/20*** | (2006.01) |
| ***F24F 13/24*** | (2006.01) |
| ***F25B 13/00*** | (2006.01) |
| ***F24F 1/32*** | (2011.01) |
| ***F24F 1/40*** | (2011.01) |
| ***F24F 1/34*** | (2011.01) |
| ***F24F 1/36*** | (2011.01) |
| ***F25B 41/40*** | (2021.01) |
| *F24F 1/56* | (2011.01) |
| *F24F 1/12* | (2011.01) |
| *F24F 3/06* | (2006.01) |

(52) U.S. Cl.
CPC ..... *F24F 1/40* (2013.01); *F24F 11/84* (2018.01); *F24F 13/20* (2013.01); *F24F 13/24* (2013.01); *F25B 13/00* (2013.01); *F25B 41/40* (2021.01); *F24F 1/12* (2013.01); *F24F 1/56* (2013.01); *F24F 3/065* (2013.01); *F24F 2013/242* (2013.01)

(58) Field of Classification Search
CPC ..... F24F 13/24; F24F 1/56; F24F 1/12; F24F 3/065; F24F 2013/242; F25B 13/00; F25B 41/003; F25B 2400/13; F25B 2400/23; F25B 40/00; F25B 2313/0231; F25B 41/04
USPC ..... 62/296
See application file for complete search history.

(56) References Cited

U.S. PATENT DOCUMENTS

| | | | | |
|---|---|---|---|---|
| 9,410,731 | B1 | 8/2016 | Rowland | |
| 2005/0207321 | A1* | 9/2005 | Song | G11B 33/08 369/247.1 |
| 2006/0076722 | A1* | 4/2006 | Huang | F16F 15/08 267/293 |
| 2009/0241577 | A1* | 10/2009 | Fukushima | F25D 17/02 62/259.1 |
| 2015/0034293 | A1* | 2/2015 | Takayama | F24F 11/83 165/207 |
| 2017/0089623 | A1* | 3/2017 | Kamitani | F16K 51/00 |
| 2018/0266705 | A1* | 9/2018 | Martinez Galvan | F24F 1/022 |

FOREIGN PATENT DOCUMENTS

| | | | | | |
|---|---|---|---|---|---|
| CN | 101245957 | A | | 8/2008 | |
| CN | 201407307 | Y | * | 2/2010 | |
| CN | 102575881 | A | | 7/2012 | |
| CN | 103353162 | A | | 10/2013 | |
| CN | 103375904 | A | | 10/2013 | |
| CN | 104154673 | A | | 11/2014 | |
| CN | 104350340 | A | | 2/2015 | |
| CN | 104350340 | A | * | 2/2015 | F25B 25/005 |
| CN | 104776630 | A | * | 7/2015 | F25B 13/00 |
| CN | 104776630 | A | | 7/2015 | |
| CN | 204438440 | U | | 7/2015 | |
| CN | 204438440 | U | * | 7/2015 | |
| CN | 204612118 | U | * | 9/2015 | |
| CN | 204612118 | U | | 9/2015 | |
| CN | 105674532 | A | | 6/2016 | |
| CN | 105864982 | A | | 8/2016 | |
| CN | 106196345 | A | | 12/2016 | |
| CN | 205957354 | U | | 2/2017 | |
| CN | 206001759 | U | | 3/2017 | |
| EP | 2204626 | A1 | | 7/2010 | |
| EP | 2204626 | A1 | * | 7/2010 | F24F 1/26 |
| EP | 2860471 | A1 | | 4/2015 | |
| EP | 2860471 | A1 | * | 4/2015 | F25B 13/00 |
| JP | 2014129948 | A | | 7/2014 | |
| KR | 20060005067 | A | | 1/2006 | |
| KR | 20070028895 | A | | 3/2007 | |
| KR | 20080016760 | A | | 2/2008 | |
| WO | WO2015087756 | A1 | | 6/2015 | |

OTHER PUBLICATIONS

GD Midea Heating & Ventilating Equipment Co. Ltd. et al., International Search Report, PCT/CN2017/084972, dated Aug. 16, 2017, 19 pgs.

GD Midea Heating & Ventilating Equipment Co. Ltd. et al., International Search Report, PCT/CN2017/089353, dated Sep. 30, 2017, 20 pgs.

GD Midea Heating & Ventilating Equipment Co. Ltd. et al., Extended European Search Report, EP17842676.3, dated Jul. 9, 2019, 7 pgs.

Guangdong Meidi Heating Ventilation Equipment Co., Ltd., First Office Action, CN Application No. 201610709381.X, dated Jun. 10, 2021, 4 pgs.

* cited by examiner

SWITCHING DEVICE FOR MULTI-SPLIT AIR CONDITIONER AND MULTI-SPLIT AIR CONDITIONER HAVING SAME

CROSS-REFERENCE TO RELATED APPLICATIONS

This patent application is a continuation application of PCT Patent Application No. PCT/CN2017/084972, entitled "SWITCHING DEVICE FOR MULTI-SPLIT AIR CONDITIONER AND MULTI-SPLIT AIR CONDITIONER HAVING SAME" filed on May 18, 2017, which claims priority to (i) Chinese Patent Application No. 201610709381.X, entitled "SWITCHING DEVICE FOR MULTI-SPLIT AIR CONDITIONER AND MULTI-SPLIT AIR CONDITIONER HAVING SAME" filed with Chinese Patent Office on Aug. 23, 2016 and (ii) Chinese Patent Application No. 201620925793.2, entitled "SWITCHING DEVICE FOR MULTI-SPLIT AIR CONDITIONER AND MULTI-SPLIT AIR CONDITIONER HAVING SAME" filed with Chinese Patent Office on Aug. 23, 2016, all of which are incorporated herein by reference in their entirety.

TECHNICAL FIELD

The present disclosure relates to a technical field of air conditioners, more particularly to a switching device for a multi-split air conditioner and a multi-split air conditioner having the same.

BACKGROUND

In the related art, in the switching device of the air conditioner, the drain tank is usually disposed inside the base, and the heat exchange part or the like is arranged above the drain tank, such that the drain tank can collect the condensed water generated by the heat exchange part. However, the noise generated when the refrigerant flows through the heat exchange system will be propagated to the base through the drain tank, which enlarges the noise of the air conditioner, thereby greatly limiting the application occasions and installation positions of the air conditioner.

In addition, although the switching device of the air conditioner can realize the separate cooling and heating of different indoor units through the valve body and the related control, due to the limitation of system setting and structural space, the number of indoor units that can be connected is relatively limited, generally less than six ports, i.e., the capacity is not large enough. If the size of the cabinet of the switching device is increased proportionally on the existing basis, the entire device will be too large, thus affecting the application occasion and the installation position. In addition, many of the existing small-sized switching devices are foamed inside the cabinet, thus making the entire refrigeration part unable to be repaired.

SUMMARY

The present disclosure aims to solve at least one of the technical problems existing in the related art. To this end, an objective of the present disclosure is to provide a switching device for a multi-split air conditioner, which can effectively reduce the noise of the air conditioner and tends not to affect the application occasion and the installation position thereof.

Another objective of the present disclosure is to provide a multi-split air conditioner having the above switching device.

The switching device for the multi-split air conditioner according to a first aspect of the present disclosure includes: a base including a bottom wall and a side wall surrounding the bottom wall and extending upward from an edge of the bottom wall; a drain tank disposed in the base and having a bottom surface spaced apart from the bottom wall of the base in an up and down direction; a plurality of damping pads disposed to the drain tank and arranged at intervals along a circumferential direction of the drain tank; a plurality of fixing members disposed to the plurality of damping pads respectively, and connected to the side wall of the base, all the plurality of fixing members being spaced apart from the drain tank.

In the switching device for the multi-split air conditioner according to the present disclosure, by spacing the bottom surface of the drain tank apart from the inner wall of the base and by disposing the damping pad to the drain tank, the drain tank is spaced apart from the fixing member. Thereby, the noise generated when the refrigerant flows through the heat exchange system is effectively prevented from being propagated through the drain tank to the base, thus greatly reducing the noise of the air conditioner using the base assembly, expanding the application occasion and the installation position of the air conditioner, and improving the comfort of the air conditioner, without affecting the application occasion and the installation position of the switching device.

In addition, the switching device for the multi-split air conditioner according to the present disclosure may further include following additional technical features.

According to some embodiments of the present disclosure, each damping pad has a clamping slot in a middle portion thereof, and the clamping slot is configured as an annular slot extending along a circumferential direction of the damping pad. Each fixing member includes: an engaging part having a groove recessed from a side of the engaging part to a center of the engaging part, the middle portion where the clamping slot is formed entering into the groove through an opening of the groove and being fitted with a bottom of the groove; a connecting part connected to a side of the engaging part adjacent to the side wall of the base and further connected to the side wall of the base.

Further, the bottom wall of the base is provided with at least one support damping pad thereon, and the support damping pad is arranged between the bottom surface of the drain tank and the bottom wall of the base.

According to some embodiments of the present disclosure, the upper surface of the support damping pad is provided with a blind hole recessed downwards, and the switching device further includes: a positioning screw penetrating through the bottom wall of the base and the bottom wall of the blind hole from the bottom up, so as to connect the support damping pad to the base.

In some embodiments, a sponge body is disposed to the bottom surface of the drain tank.

Specifically, an anti-vibration gum is disposed on the bottom wall of the base.

According to some embodiments of the present disclosure, the multi-split air conditioner includes an outdoor unit and a plurality of indoor units having a plurality of first ports and a plurality of second ports. The switching device further includes: a housing having an open bottom and arranged above the base; a gas-liquid separator disposed in the housing, the gas-liquid separator has an inlet, a first outlet and a second outlet, the inlet being configured to be connected to the outdoor unit; a plurality of first indoor-unit connection tubes spaced apart from one another in a first direction, the first outlet being connected to the plurality of first ports respectively via the plurality of first indoor-unit connection tubes; at least one heat exchange part having an end connected to the second outlet; and a plurality of second indoor-unit connection tubes spaced apart from the plurality of first indoor-unit connection tubes in a second direction perpendicular to the first direction, and the plurality of second indoor-unit connection tubes being spaced apart from one another in the first direction, the heat exchange part having another end connected to the plurality of second ports respectively via the plurality of second indoor-unit connection tubes, and part of the plurality of first indoor-unit connection tubes and the plurality of second indoor-unit connection tubes are spaced apart from the rest of the first indoor-unit connection tubes and the second indoor-unit connection tubes in the second direction.

Further, the switching device further includes: a solenoid valve assembly including a plurality of solenoid valve units arranged side by side, a first U-shaped tube and a second U-shaped tube, each solenoid valve unit including a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to guide a refrigerant in the first U-shaped tube to the corresponding first indoor-unit connection tube unidirectionally, the second one-way solenoid valve being configured to guide the refrigerant in the first indoor-unit connection tube to the outdoor unit unidirectionally, and one of the first U-shaped tube and the second U-shaped tube being disposed at an inner side of the other one of the first U-shaped tube and the second U-shaped tube; and a check valve assembly disposed below the solenoid valve assembly, the check valve assembly including a plurality of check valve units arranged side by side and extending in a horizontal direction, each check valve unit including a first check valve and a second check valve configured to be arranged in parallel between the heat exchange part and the second indoor-unit connection tube, the first check valve being configured to guide the refrigerant in the heat exchange part to the indoor unit unidirectionally, and the second check valve being configured to guide the refrigerant in the indoor unit to the heat exchange part unidirectionally.

According to some embodiments of the present disclosure, the housing has a substantially cuboid shape, and the first direction is a length direction of the housing, the heat exchange part. The solenoid valve assembly and the check valve assembly are all disposed in the housing, and the solenoid valve assembly is arranged above the check valve assembly. The solenoid valve assembly and the check valve assembly are disposed at one side in the length direction of the housing, while the gas-liquid separator and the heat exchange part are disposed at the other side in the length direction of the housing. The gas-liquid separator and the heat exchange part are arranged sequentially in a width direction of the housing. An electric control box assembly is disposed outside the housing. The electric control box assembly is arranged vertically and disposed to a side surface of the housing.

A multi-split air conditioner according to a second aspect of the present disclosure includes the switching device for the multi-split air conditioner according to the above first aspect of the present disclosure.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the present disclosure will become apparent and more readily appreciated from descriptions of embodiments made with reference to the following drawings, in which.

Figure 1:
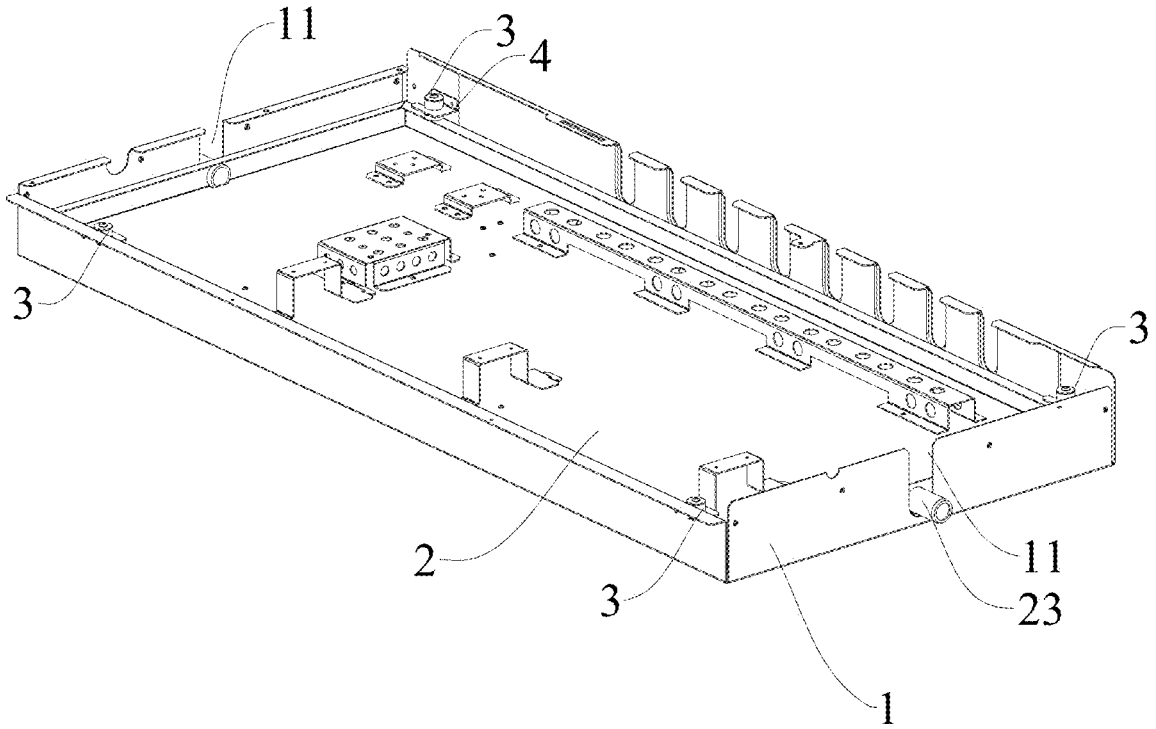
FIG. 1 is a perspective view of a base according to an embodiment of the present disclosure.

REFERENCE NUMERALS switching device 100,
base 1, mounting portion 11, anti-vibration gum 12, second relief portion 121,
drain tank 2, drain-tank bottom wall 21, drain-tank side wall 22, flange 221, drain pipe 23, sponge body 24,
damping pad 3, clamping slot 31,
fixing member 4, engaging part 41, groove 411, connecting part 42,
threaded fastener 5, support damping pad 6, blind hole 61, weight-reducing groove 62, positioning screw 7,
housing 10, top cover 120,
gas-liquid separator 20, inlet 210, first outlet 220, second outlet 230,
first indoor-unit connection tube 30, heat exchange part 40, second indoor-unit connection tube 50, solenoid valve assembly 60,
solenoid valve unit 610, first one-way solenoid valve 6110, second one-way solenoid valve 6120,
first U-shaped tube 620, second U-shaped tube 630,
check valve assembly 70, first check valve 710, second check valve 720,
extension section 80, throttling device 90, electric control box assembly 910.

DETAILED DESCRIPTION

Embodiments of the present disclosure will be described in detail and examples of embodiments are illustrated in the drawings. The same or similar elements and the elements having the same or similar functions are denoted by like reference numerals throughout the descriptions. Embodiments described herein with reference to drawings are explanatory, serve to explain the present disclosure, and are not construed to limit embodiments of the present disclosure.

In the description of the specification, it should be understood that the orientation or positional relationship indicated by the terms such as "central", "length", "width", "thickness", "upper", "lower", "front", "rear", "left", "right", "vertical", "horizontal", "top", "bottom", "inner", "outer", "axial" and "circumferential" and the like is based on the orientation or positional relationship shown in the drawings, only for convenience of description of the present disclosure and simplification, and is not intended to indicate or imply that the device or component referred to has a particular orientation, is constructed and operated in a particular orientation, and thus is not to be understood as limiting the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this features either explicitly or implicitly.

In the description of the present disclosure, unless specified or limited otherwise, the terms "mounted", "connected", "coupled" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A switching device 100 for a multi-split air conditioner according to an embodiment of the present disclosure will be described with reference to FIGS. 1-9. The switching device 100 is suitable for an air conditioner, such as a multi-split air conditioner or the like.

As shown in FIG. 1, the switching device 100 for the multi-split air conditioner according to a first aspect of embodiments of the present disclosure includes a base 1, a drain tank 2, a plurality of damping pads 3, and a plurality of fixing members 4. The base 1 may be a bottom support of the switching device 100.

Figure 2:
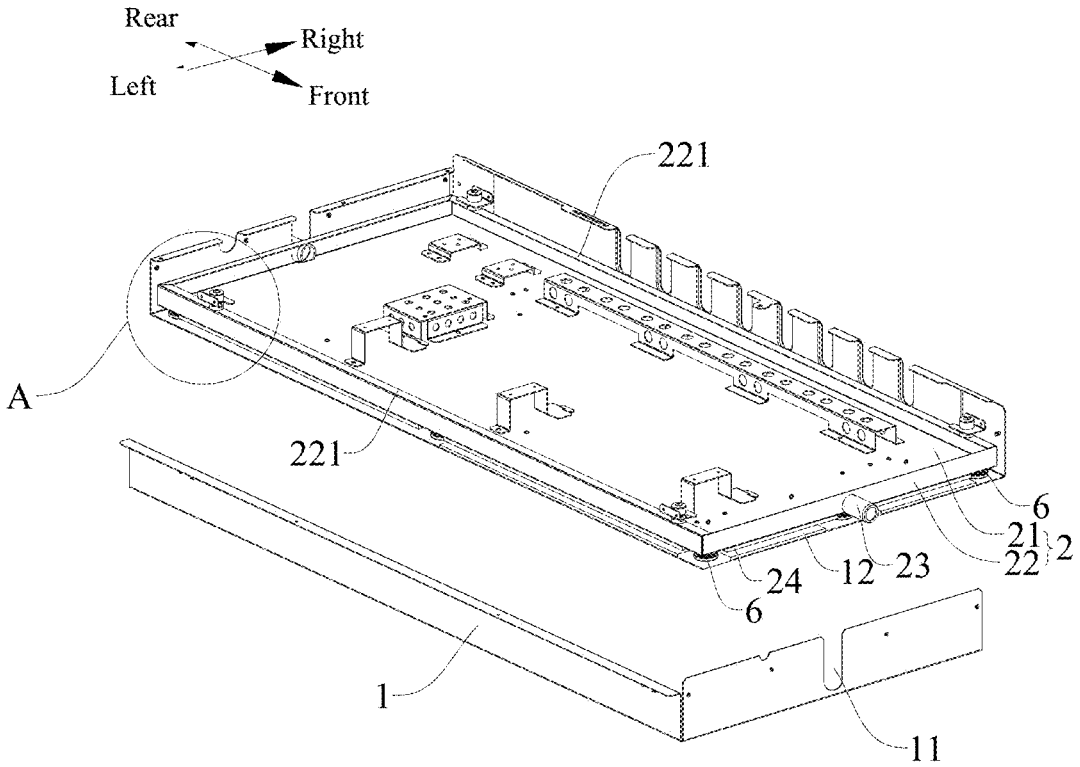
FIG. 2 is an exploded view of the base shown in FIG. 1.

Specifically, referring to FIGS. 1 and 2, the base 1 includes a bottom wall and a side wall, and the side wall of the base 1 surrounds the bottom wall of the base 1 and extends upwards from an edge of the bottom wall. The bottom wall of the base 1 may be formed in a substantially rectangular shape, but is not limited thereto. For example, the bottom wall of the base 1 may be formed in a circular shape, a triangular shape, or an irregular shape. The specific shape thereof may be adjusted and designed according to the specification of the air conditioner, and the present disclosure does not particularly limit this. The side wall of the base 1 may surround the bottom wall of the base 1 and extend vertically upwards from the bottom wall of the base 1. The structure is simple, the processing is convenient, and it is easy for the base assembly 100 to be assembled with parts, such as a housing, of the air conditioner.

The drain tank 2 is disposed in the base 1, and a bottom surface of the drain tank 2 is spaced apart from the bottom wall of the base 1 in an up and down direction. Specifically, referring to FIG. 2, the drain tank 2 includes a drain-tank bottom wall 21 and a drain-tank side wall 22. The drain-tank side wall 22 surrounds the drain-tank bottom wall 21 and extends upwards from an edge of the drain-tank bottom wall 21 to define a water collecting sump between the drain-tank bottom wall 21 and the drain-tank side wall 22. Thereby, it is convenient for the drain tank 2 to collect condensed water or the like generated by heat exchange parts of the air conditioner.

The lower surface of the drain-tank bottom wall 21 is spaced apart from the bottom wall of the base 1 in an up and down direction. That is, the lower surface of the drain-tank bottom wall 21 is not in direct contact with the bottom wall of the base 1. Thereby, it is possible to effectively prevent the noise generated when the refrigerant flows through the heat exchange system from being propagated through the drain tank 2 to the base 1, thereby greatly reducing the noise of the air conditioner using the base assembly 100.

Further, the drain-tank side wall 22 is provided with a drain pipe 23 disposed adjacent to the drain-tank bottom wall 21 of the drain tank. The side wall of the base 1 is provided with a mounting portion 11, and the drain pipe 23 passes through the mounting portion 11 to facilitate the discharge of water in the water collecting sump. The mounting portion 11 may be formed as a U-shaped groove (as shown in FIG. 1) penetrating a top of the side wall of the base 1, but is not limited thereto. For example, the mounting portion 11 may also be formed as a through hole (not shown) penetrating the direction of the side wall of the base 1 in a thickness direction of the side wall of the base 1.

The plurality of damping pads 3 are disposed on the drain tank 2 and arranged at intervals along a circumferential direction of the drain tank 2. Specifically, the drain-tank side wall 22 may be provided with a flange 221 extending horizontally towards a center of the drain tank 2, and the damping pad 3 may be disposed on the flange 221. For example, in the example of FIG. 2, the left side wall and the right side wall of the drain tank 2 each are provided with the flange 221, and four damping pads 3 are provided. The flange 221 of the left side wall of the drain tank 2 is provided with two damping pads 3, and the right side wall of the drain tank 2 is provided with other two damping pads 3.

It should be noted herein that, in the description of the present disclosure, "a plurality of" means two or more, for example, three or four, unless specified otherwise.

Figure 3:
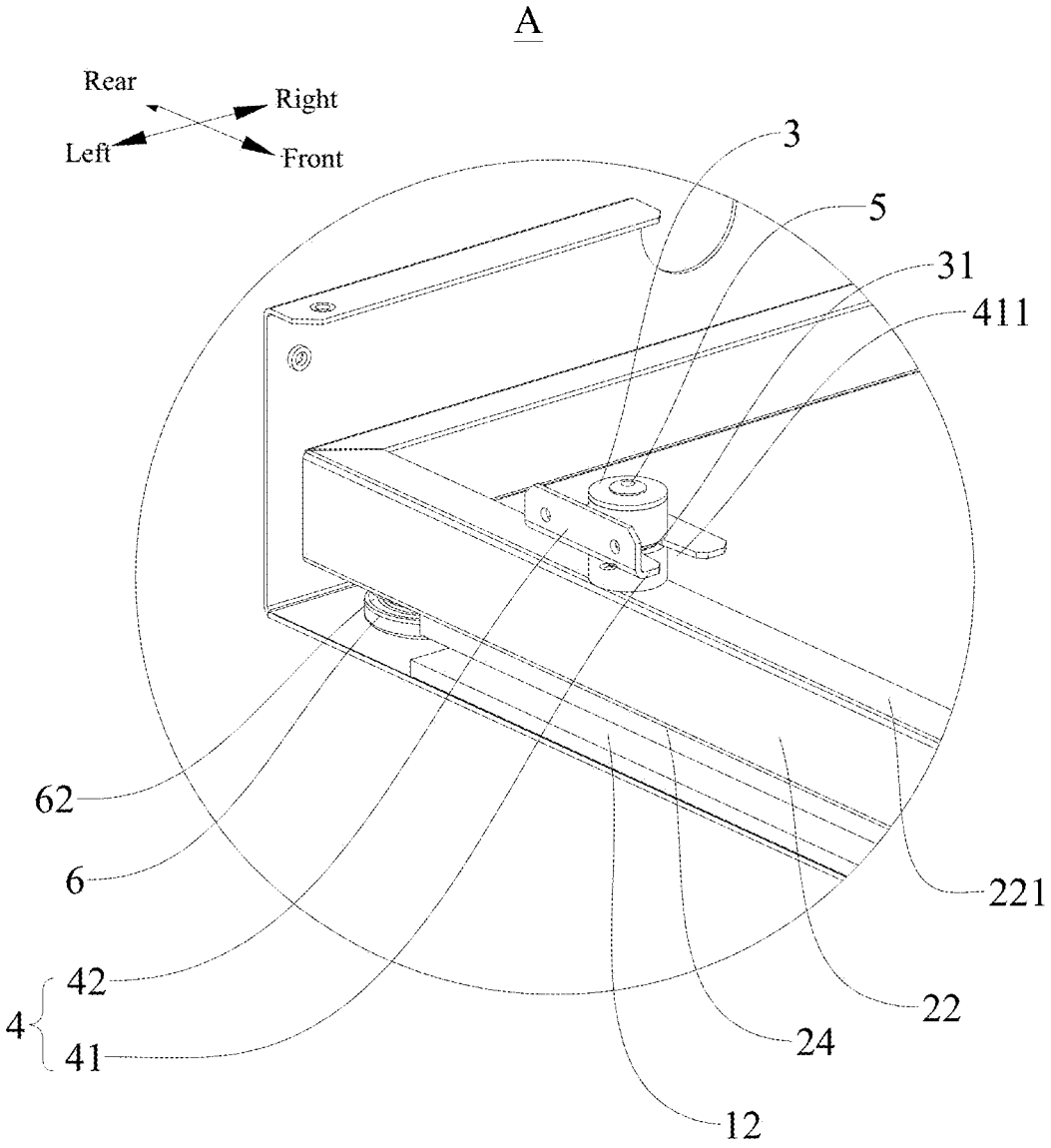
FIG. 3 is an enlarged view of portion A circled in FIG. 2.

Specifically, referring to FIG. 2 and combining with FIG. 3, the damping pad 3 may be connected to the drain tank 2 by a threaded fastener 5. The threaded fastener 5 may be a screw, a bolt or the like. For example, the damping pad 3 may be provided with a screw hole through which the threaded fastener 5 may be connected to the drain tank 2. The structure is simple and the assembling is convenient.

The plurality of fixing members 4 are correspondingly disposed to the plurality of damping pads 3 and further connected to the side wall of the base 1, and all the plurality of fixing members 4 are spaced apart from the drain tank 2. Specifically, referring to FIG. 2 and combining with FIG. 3, the fixing member 4 may be firstly fitted with the damping pad 3 and then connected to the side wall of the base 1, and the drain tank 2 is spaced apart from the fixing member 4 by the damping pad 3. The fixing member 4 may be connected to the side wall of the base 1 by a screw or the like (not shown).

For example, during assembling, the fixing member 4 may be first fitted with the damping pad 3, and then the fixing member 4 is connected to the side wall of the base 1 by the screw. Thereby, the drain tank 2 can be firmly fixed to the base 1, and the fixing member 4 can be effectively prevented from being in direct contact with the drain tank 2. Therefore, it is possible to effectively prevent the noise generated when the refrigerant flows through the heat exchange system from being propagated through the drain tank 2 to the side wall of the base 1, thereby further reducing the noise of the air conditioner using the switching device 100, expanding the application occasion and installation position of the air conditioner, and improving the comfort of the air conditioner. In addition, the vibration of the switching device 100 can be effectively reduced, and the stability of the switching device 100 can be improved.

In the switching device 100 for the multi-split air conditioner according to the embodiment of the present disclosure, since the bottom surface of the drain tank 2 is spaced apart from the inner wall of the base 1 and the drain tank 2 is provided with the damping pad 3, the drain tank 2 is spaced apart from the fixing member 4. Thereby, the noise generated when that the refrigerant flows through the heat exchange system is effectively prevented from being propagated through the drain tank 2 to the base 1, thus greatly reducing the noise and vibration of the air conditioner using the switching device 100. Therefore, the application occasion and installation position of the switching device will not be affected, but will be expanded, and also, the comfort and stability of the air conditioner will be improved.

According to some embodiments of the present disclosure, referring to FIG. 3, each damping pad 3 has a clamping slot 31 in a middle portion thereof. It can be understood that the above "middle portion" refers to a middle portion in a broad sense, and specifically, a portion between a upper surface and a lower surface of the damping pad 3 can be understood as "the middle portion of the damping pad 3". For example, in the example of FIG. 3, the damping pad 3 may be formed in a substantially cylindrical shape, and the clamping slot 31 may be formed as an annular slot extending along a circumferential direction of the damping pad 3, but is not limited thereto.

Each fixing member 4 includes an engaging part 41 and a connecting part 42. The engaging part 41 has a groove 411 recessed from a side (for example, a front side in FIG. 3) of the engaging part 41 to a center of the engaging part 41, and the portion of the damping pad 3 where the clamping slot 31 is formed goes into the groove 41 through an opening of the groove 411 and is fitted with a bottom of the groove 411. The connecting part 42 is connected to a side (for example, a left side in FIG. 3) of the engaging part 41 adjacent to the side wall of the base 1 and is connected to the side wall of the base 1. For example, referring to FIG. 3, the groove 411 may be generally formed in a U shape, and the bottom of the groove 411 may be understood as a closed end of the U shape. During assembling, the bottom of the groove 411 may be first caught at the clamping slot 31, and then the connecting part 42 is fixed to the side wall of the base 1 by the screw. The structure is simple and the assembling is convenient.

Alternatively, the fixing member 4 may be a sheet metal part, but is not limited thereto. Thereby, the drain tank 2 can be fixed to the side wall of the base 1 firmly, so as to improve the reliability of the base assembly 100.

According to some embodiments of the present disclosure, each damping pad 3 may be a rubber member, but is not limited thereto. For example, the damping pad 3 may also be a plastic member or the like. Thereby, the noise reduction effect can be effectively improved, the vibration of the base assembly 100 can be reduced, the processing is convenient, and the material cost and the processing cost are low.

Further, the bottom wall of the base 1 is provided with at least one support damping pad 6, and the support damping pad 6 is located between the bottom surface of the drain tank 2 and the bottom wall of the base 1. Specifically, one or more support damping pads 6 may be provided. For example, referring to FIG. 4, a plurality of support damping pads 6 are provided, and specifically nine support damping pads 6 are provided. Thereby, the drain tank 2 can be supported by the support damping pad 6, such that the position of the drain tank 2 is stabilized, thereby improving the performance of the drain tank 2, and the propagation of the noise generated by the refrigerant to the base 1 can be reduced by the support damping pad 6. In addition, the vibration of the switching device 100 can be effectively reduced, and the stability of the switching device 100 can be improved.

Alternatively, the support damping pad 6 may be a rubber member, but is not limited thereto. For example, the support damping pad 6 may also be a plastic member or the like. Thereby, the effects of noise reduction and vibration reduction can be effectively improved, the processing is convenient and the cost is low.

Figure 4:
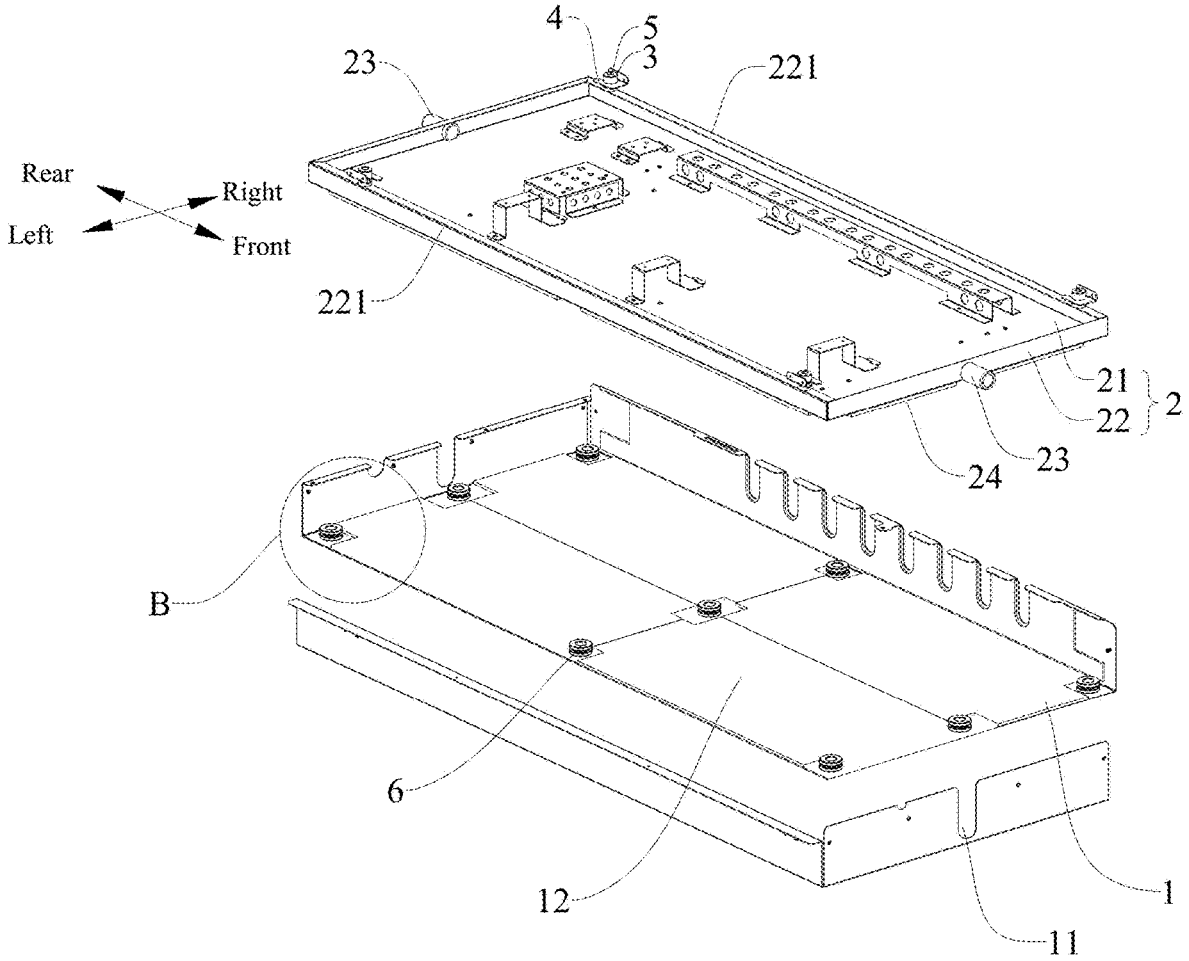
FIG. 4 is another exploded view of the base shown in FIG. 1.
Figure 5:
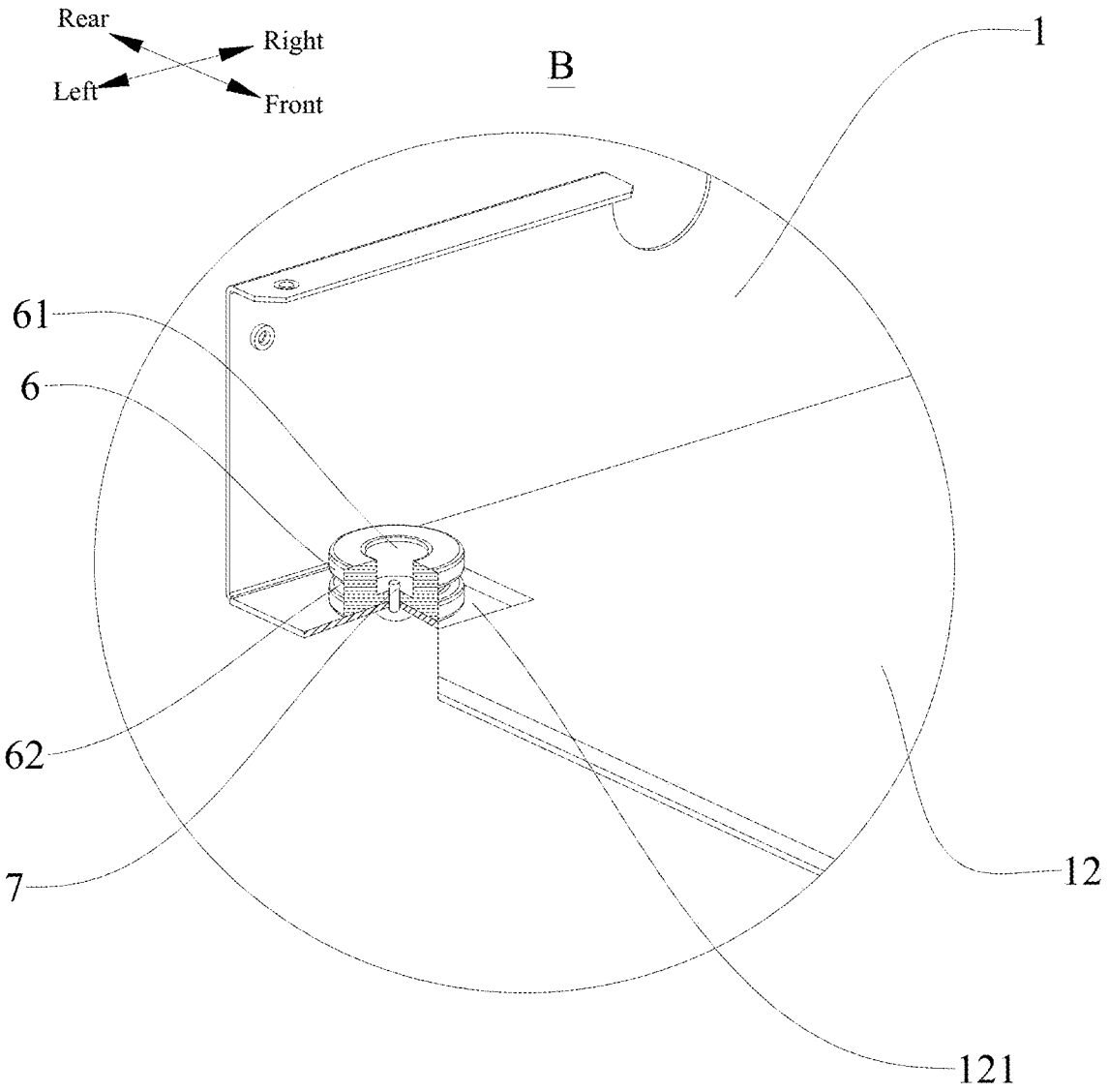
FIG. 5 is an enlarged view of portion B circled in FIG. 4.

According to some embodiments of the present disclosure, referring to FIG. 4 and combining with FIG. 5, an upper surface of the support damping pad 6 is formed with a blind hole 61 recessed downwards, and the support damping pad 6 may be formed substantially in the shape of a cylinder. A cross section of the blind hole 61 may have a circular shape, and a central axis of the blind hole 61 may coincide with a central axis of the support damping pad 6. Therefore, the material of the support damping pad 6 can be effectively reduced, thereby effectively reducing the material cost of the support damping pad 6. In addition, the weight of the support damping pad 6 is effectively reduced, and the contact area of the support damping pad 6 and the drain tank 2 is increased, thereby further improving the stability of the drain tank 2.

In some embodiments, an outer peripheral wall of the support damping pad 6 is provided with at least one weight-reducing groove 62. One or more weight-reducing grooves 62 may be provided. The weight-reducing groove 62 may be formed by recessing the outer peripheral wall of the support damping pad 6 towards a center of the support damping pad 6. The weight-reducing groove 62 may extend along a circumferential direction of the support damping pad 6 or may extend along an axial direction of the support damping pad 6, which is not specifically limited in the present disclosure. For example, in the example of FIG. 5, one weight-reducing groove 62 is provided, and extends along the circumferential direction of the support damping pad 6, such that the structure is simple and the processing is easy.

Further, the switching device 100 also includes a positioning screw 7. Referring to FIG. 5, the positioning screw 7 penetrates through the bottom wall of the base 1 and a bottom wall of the blind hole 61 of the support damping pad 6 from the bottom up, so as to connect the support damping pad 6 to the base 1. Therefore, the support damping pad 6 can be firmly connected to the bottom wall of the base 1, such that the position of the support damping pad 6 is stabilized, thereby improving the performance of supporting, noise reduction and vibration damping of the support damping pad 6.

According to some embodiments of the present disclosure, the support damping pad 6 may be provided with a positioning hole configured to be fitted with the positioning screw 7, and an inner diameter of the positioning hole may be slightly smaller than an outer diameter of the positioning screw 7, such that the fit between the positioning hole and the positioning screw 7 can be closer and firmer.

During assembling, the positioning screw 7 sequentially passes through the bottom wall of the base 1 and the positioning hole from the bottom up to fix the support damping pad 6 to the base 1. Thereby, the assembling difficulty of the support damping pad 6 is reduced, and the firmness of the support damping pad 6 is improved.

Specifically, the positioning hole may be located below the blind hole 61 and penetrate the bottom wall of the blind hole 61. That is, the positioning hole may be formed as a through hole. Thereby, the firmness of the support damping pad 6 is further improved, the structure is simple, the processing is convenient, and the processing cost is reduced.

According to some embodiments of the disclosure, a sponge body 24 may be disposed to the bottom surface of the drain tank 2. Thereby, condensation on the bottom surface of the drain tank 2 can be effectively reduced, and the noise can be further prevented from being propagated downwards through the bottom of the drain tank 2. In addition, the vibration of the base assembly 100 can be further reduced.

The sponge body 24 may be adhered to the bottom surface of the drain tank 2. The area of the sponge body 24 may be substantially the same with that of the bottom surface of the drain tank 2, and one or more sponge bodies 24 may be provided. Further, the sponge body 24 is provided with a first relief portion configured to avoid the support damping pad 6, such that the support damping pad 6 can be in direct contact with the bottom surface of the drain tank 2, thereby ensuring the stability of the drain tank 2.

Further, an anti-vibration gum 12 is disposed on the bottom wall of the base 1. Specifically, the anti-vibration gum 12 may be adhered to an inner wall of the base 1 and located below the drain tank 2. Specifically, the anti-vibration gum 12 may be located below the sponge body 24. Thereby, the propagation of the noise and the vibration of the base assembly 100 can be further reduced, thus further improving the effect of vibration reduction and noise reduction.

Alternatively, a plurality of pieces of anti-vibration gum 12 may be provided, and the plurality of pieces of anti-vibration gum 12 are spliced together on the inner wall of the base 1. For example, in the example of FIG. 4, four pieces of anti-vibration gum 12 are provided. Thereby, the adhering difficulty of the anti-vibration gum 12 is effectively reduced, and the assembling efficiency is improved.

Specifically, the anti-vibration gum 12 may be formed in a substantially rectangular shape, but is not limited thereto. The anti-vibration gum 12 may be provided with a second relief portion 121 in a portion thereof adjacent to the support damping pad 6, so as to facilitate the assembling of the support damping pad 6.

The multi-split air conditioner includes an outdoor unit and a plurality of indoor units having a plurality of first ports and a plurality of second ports. The outdoor unit is connected to the plurality of indoor units through the switching device 100, and the plurality of indoor units may be respectively disposed in a plurality of rooms, such that separate cooling or heating in different rooms can be realized by the switching device 100. In the description of the present disclosure, "a plurality" means two or more, unless specified otherwise.

Figure 6:
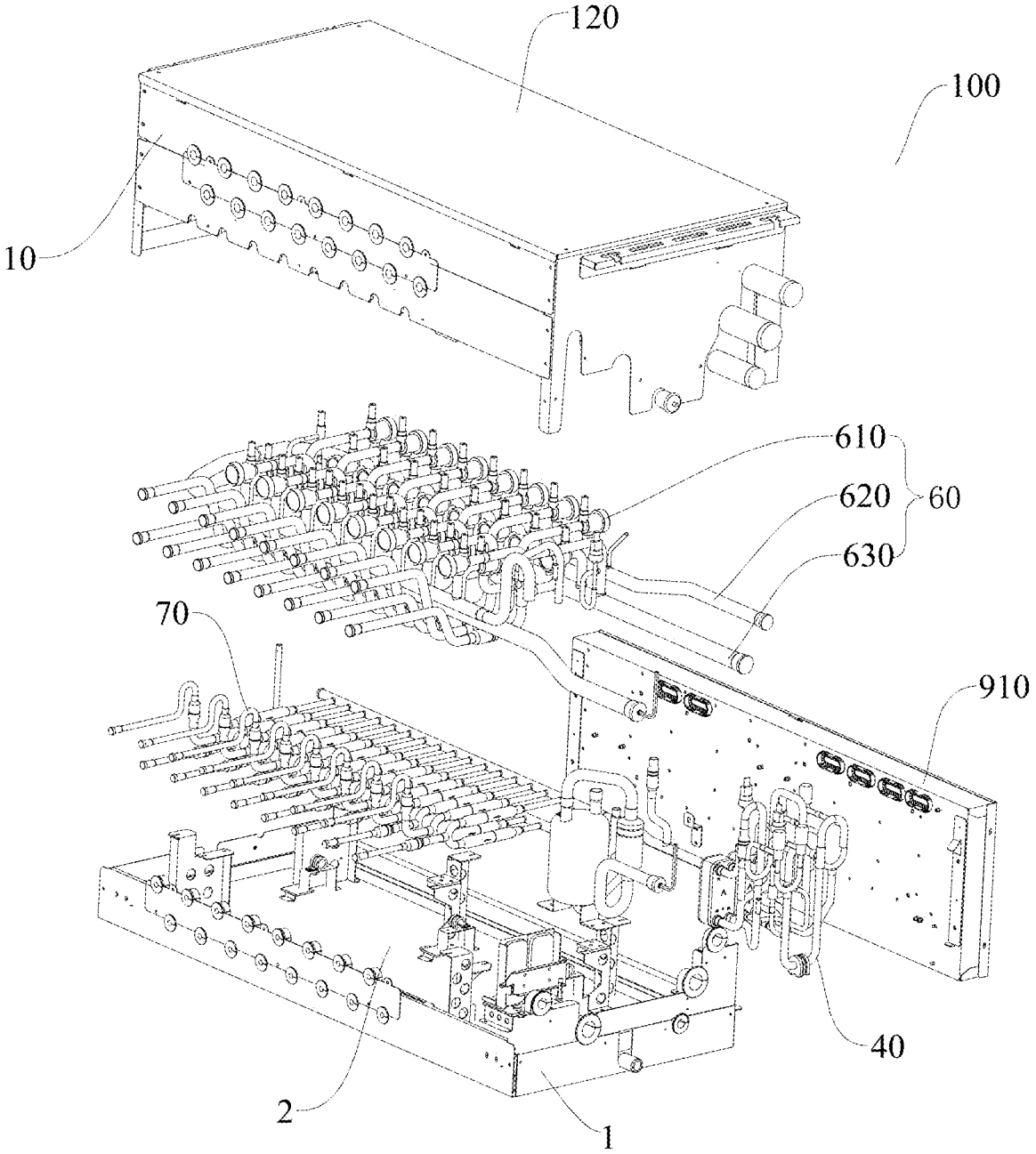
FIG. 6 is an exploded view of a switching device according to an embodiment of the present disclosure.
Figure 9:
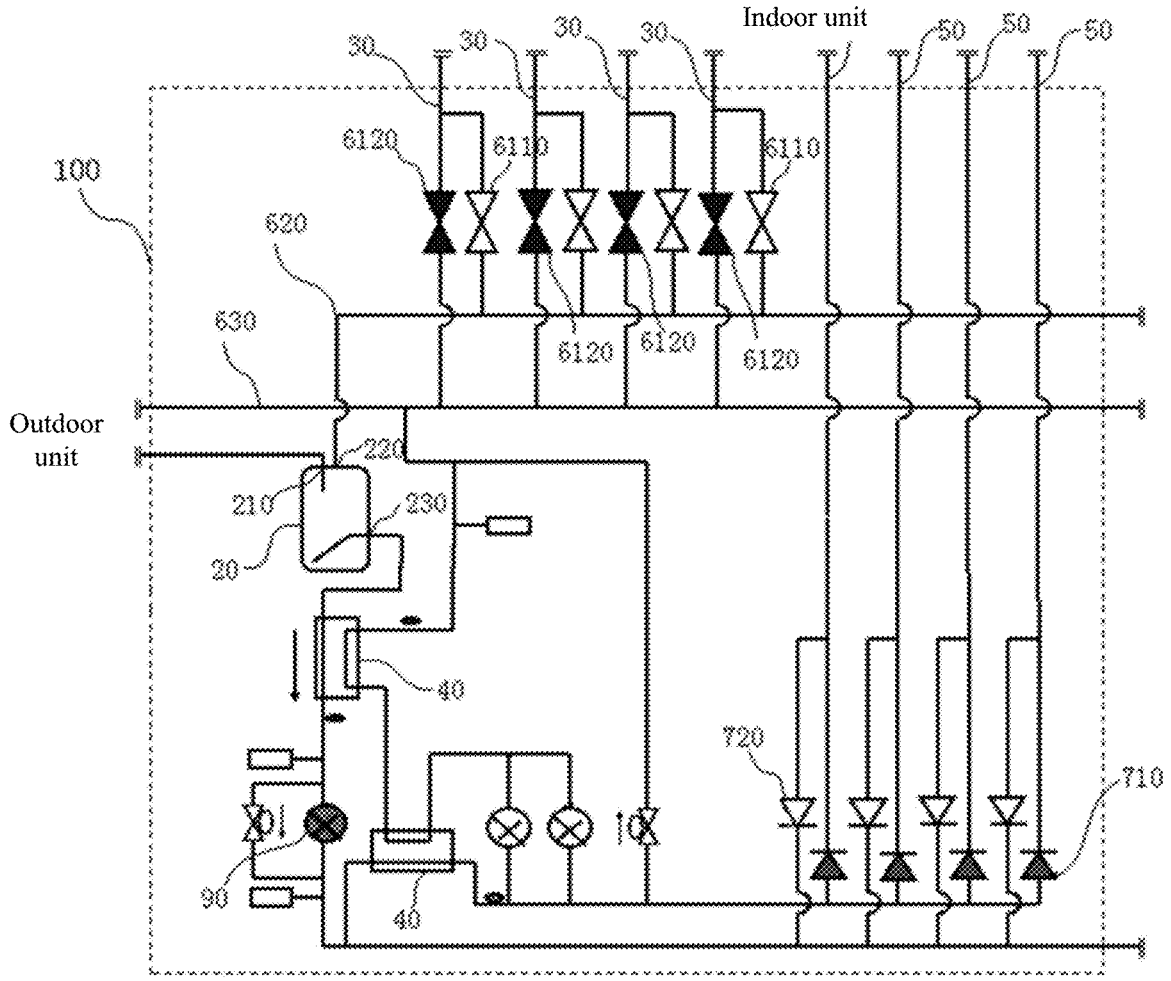
FIG. 9 is a schematic view of a switching device according to an embodiment of the present disclosure.

As shown in FIG. 6 and FIG. 9, the switching device 100 includes a housing 10, a gas-liquid separator 20, a plurality of first indoor-unit connection tubes 30, at least one heat exchange part 40, and a plurality of second indoor-unit connection tubes 50.

It should be noted that, in descriptions of the present disclosure, terms such as "first" and "second" are used herein for purposes of description and are not intended to indicate or imply relative importance or significance or to imply the number of indicated technical features. Thus, the feature defined with "first" and "second" may include one or more this feature.

The bottom of the housing 10 is open and the housing is arranged above the base 1. The housing 10 functions to close and protect the various parts disposed therein. The gas-liquid separator 20 is disposed in the housing 10, and the gas-liquid separator 20 may be used for a gas-liquid separation of a gas-liquid two-phase refrigerant entering from the outdoor unit, so as to improve the heating and cooling effects. The gas-liquid separator 20 has an inlet 210, a first outlet 220 and a second outlet 230. The inlet 210 is configured to be connected to the outdoor unit, such that the refrigerant entering through the inlet 210 is discharged out of the first outlet 220 and the second outlet 230 respectively after being subjected to the gas-liquid separation in the gas-liquid separator 20.

During the operation of the air conditioner, the gas-liquid separator 20 can separate the gas-liquid two-phase refrigerant, such that the gaseous refrigerant flows out of the gas output pipe, and the liquid refrigerant flows out of the liquid output pipe. At the same time, the gaseous refrigerant can flow from the gas side to the indoor units for heating, and on the contrary, the liquid refrigerant flows from the liquid side to the indoor units for cooling, in which the control of the different indoor units is realized separately by the reverse control of the corresponding solenoid valve. In the following description of the present disclosure, an example, in which the separated gaseous refrigerant is discharged out of the first outlet 220 and the separated liquid refrigerant is discharged out of the second outlet 230, will be described for illustration. In this case, the first outlet 220 is preferably disposed to the top of the gas-liquid separator 20, and the second outlet 230 is preferably disposed to a lower portion of the gas-liquid separator 20. The inlet 210 may be in the form of a section of inlet pipe, and an end of the inlet pipe preferably extends into the gas-liquid separator 20, so as to provide a better gas-liquid separation effect.

An end of the heat exchange part 40 is connected to the second outlet 231 of the gas-liquid separator 21. Therefore, by arranging the heat exchange part 40 downstream of the liquid refrigerant outlet of the gas-liquid separator 20, the separated liquid refrigerant enters the heat exchange part 40, and is subjected to the heat exchange and supercooling of the heat exchange part 40, such that it is possible to effectively ensure that the refrigerant flowing through the heat exchange part 40 is completely liquid.

The plurality of first indoor-unit connection tubes 30 are spaced apart from one another in a first direction (e.g. a length direction in FIG. 6), and the first outlet 220 is connected to the plurality of first ports respectively via the plurality of first indoor-unit connection tubes 30. The plurality of second indoor-unit connection tubes 50 are spaced apart from one another in the first direction, and another end of the heat exchange part 40 is connected to the plurality of second ports respectively via the plurality of second indoor-unit connection tubes 50. Therefore, by providing the first indoor-unit connection tube 30 and the second indoor-unit connection tube 50, the circulation flow of the refrigerant among the indoor unit, the first indoor-unit connection tube 30 and the second indoor-unit connection tube 50 can be realized after the indoor unit is assembled in place with the first indoor-unit connection tube 30 and the second indoor-unit connection tube 50 of the switching device 100 through the first port and the second port, and the connection between the switching device 100 and the indoor unit is facilitated. The plurality of first indoor-unit connection tubes 30 and the plurality of second indoor-unit connection tubes 50 are preferably arranged at even intervals in the first direction.

The plurality of second indoor-unit connection tubes 50 are spaced apart from the plurality of first indoor-unit connection tubes 30 in a second direction perpendicular to the first direction. In some embodiments, the first indoor-unit connection tube 30 and the corresponding second indoor-unit connection tube 50 (i.e., the second indoor-unit connection tube 50 connected to the same indoor unit to which the first indoor unit 30 is connected) have a one-to-one correspondence in the second direction (e.g., the first indoor-unit connection tube 30 and the second indoor-unit connection tube 50 are aligned in an up and down direction, in the example of FIG. 6). Thereby, the first indoor-unit connection tube 30 and the second indoor-unit connection tube 50 connected to the indoor unit are arranged in two layers, which relatively reduces a size of the switching device 100 in the first direction.

Part of the plurality of first indoor-unit connection tubes 30 and the plurality of second indoor-unit connection tubes 50 (which may be one or more) are spaced apart from the rest of the first indoor-unit connection tubes and the second indoor-unit connection tubes in the second direction. Thereby, the first indoor-unit connection tubes 30 and the second indoor-unit connection tubes 50 connected to the indoor units are respectively arranged in plurality of layers, which can further reduce the size of the switching device 100 in the first direction, thereby making the structure of entire switching device 100 simple and compact, and thus expanding the installation position and application occasion of the switching device 100. The indoor unit may have one first port and one second port respectively, the plurality of first indoor-unit connection tubes 30 are in one-to-one correspondence to the plurality of first ports, and the plurality of second indoor-unit connection tubes 50 are in one-to-one correspondence to the plurality of second ports.

For example, as shown in FIG. 6, the first indoor-unit connection tube 30 and the second indoor-unit connection tube 50 both extend out of the side wall of the housing 10, such that the "first direction" may be the length direction of the housing 1 shown in FIG. 6 and the "second direction" may be a height direction of the housing 10 shown in FIG. 6. Thereby, the length of the entire switching device 100 in the length direction is effectively saved, and the number of the indoor units to which the switching device 100 can be connected is relatively expanded. For example, the switching device 100 according to the present disclosure can be connected to more than six indoor units (e.g., the switching device 100 can be connected to sixteen indoor units in the example of FIG. 6), thereby implementing the control of the plurality of rooms. Of course, the "first direction" may also be the length direction of the housing 10 shown in FIG. 6, while the "second direction" is a width direction of the housing 10 shown in FIG. 6. In this case, both the first indoor-unit connection tube 30 and the second indoor-unit connection tube 50 extend out of a top wall of the housing 1. Alternatively, the "first direction" may be inclined with respect to the length direction of the housing 10 shown in FIG. 6. It can be understood that the specific orientations of the "first direction" and the "second direction" may be specifically configured according to the actual assembling requirements of the first indoor-unit connection tube 30 and the second indoor-unit connection tube 50, so as to better meet the requirements of practical application occasions and installation positions.

In the switching device 100 for the multi-split air conditioner according to the embodiment of the present disclosure, by arranging the first indoor-unit connection tubes 30 and the second indoor-unit connection tubes 50 configured to be connected to the indoor units into the plurality of layers, the length of the switching device 100 in the first direction can be relatively reduced, so as not to affect the application occasions and installation positions of the switching device 100. Further, by providing the gas-liquid separator 20 to perform the gas-liquid separation on the refrigerant, the state of the refrigerant can be improved and the noise of the multi-split air conditioner can be reduced, thereby further facilitating the heating or cooling of the multi-split air conditioner.

According to some embodiments of the present disclosure, the plurality of first indoor-unit connection tubes 30 are arranged in a plurality of layers spaced apart from one another in the second direction, and each layer of the first indoor-unit connection tubes 30 include at least one first indoor-unit connection tube 30; the plurality of second indoor-unit connection tubes 50 are arranged in a plurality of layers spaced apart from one another in the second direction, and each layer of the second indoor-unit connection tubes 50 include at least one second indoor-unit connection tube 50; and the plurality of layers of the first indoor-unit connection tubes 30 are spaced apart from the plurality of layers of the second indoor-unit connection tubes 50 in the second direction. Thereby, the length of the switching device 100 in the first direction can be further reduced. In some embodiments, two adjacent layers of the first indoor-unit connection tubes 30 are staggered with one another in the first direction, and two adjacent layers of the second indoor-unit connection tube 50 are staggered with one another in the first direction. Thereby, the first indoor-unit connection tubes 30 and the second indoor-unit connection tubes 50 can be arranged more compactly in the first direction, thus reducing the space occupied by the entire switching device 100, and further expanding the application occasions and installation positions of the switching device 100.

For example, in the example of FIG. 6, sixteen first indoor-unit connection tubes 30 and sixteen second indoor-unit connection tubes 50 are respectively provided, and the first indoor-unit connection tubes 30 and the second indoor-unit connection tubes 50 are respectively arranged in two layers. Each layer includes eight first indoor-unit connection tubes 30 or eight second indoor-unit connection tubes 50 evenly spaced apart from one another in the length direction of the housing 10, and the four layers of the first indoor-unit connection tubes 30 and the second indoor-unit connection tubes 50 are evenly spaced from one another in the height direction of the housing 1. A group of the first indoor-unit connection tube 30 and the second indoor-unit connection tube 50 connected to the same indoor unit are aligned with each other in the up and down direction. Further, the two layers of the first indoor-unit connection tubes 30 are staggered along the length direction of the housing 10, and the two layers of the second indoor-unit connection tubes 50 are staggered along the length direction of the housing 10, such that the first indoor-unit connection tubes 30 and the second indoor-unit connection tubes 50 can be arranged more compactly in the length direction of the housing 10, reducing the volume of the switching device 100, thereby reducing the space occupied by the switching device 100.

According to some embodiments of the present disclosure, as shown in FIGS. 6-9, the switching device 100 for the multi-split air conditioner further includes a solenoid valve assembly 60, and the solenoid valve assembly 60 includes a first U-shaped tube 620, a second U-shaped tube 630, and a plurality of solenoid valve units 610 arranged side by side. Therefore, by arranging the plurality of solenoid valve units 610 side by side, the entire solenoid valve assembly 60 has a modular design such that the entire structure of the solenoid valve assembly 60 is arranged in an orderly and compact manner.

Specifically, each solenoid valve unit 610 includes a first one-way solenoid valve 6110 and a second one-way solenoid valve 6120 for controlling different flow directions of heating and cooling of the multi-split air conditioner. The first U-shaped tube 620 is connected to the first outlet 220 and further connected to the plurality of first indoor-unit connection tubes 30 respectively via the plurality of first one-way solenoid valves 6110. The first one-way solenoid valve 6110 is configured to guide the refrigerant in the first U-shaped tube 620 into the corresponding first indoor-unit connection tube 30 unidirectionally, while the refrigerant in the first indoor-unit connection tube 30 cannot enter the first U-shaped tube 620 through the first one-way solenoid valve 6110. The plurality of first indoor-unit connection tubes 30 are configured to be connected to the outdoor unit respectively via the plurality of second one-way solenoid valves 6120. The second one-way solenoid valve 6120 is configured to guide the refrigerant in the first indoor-unit connection tube 30 into the outdoor unit unidirectionally, while the refrigerant in the outdoor unit cannot enter the first indoor-unit connection tube 30 through the second one-way solenoid valves 6120. Thereby, the gaseous refrigerant separated from the gas-liquid separator 20 enters the first one-way solenoid valve 6110 through the first U-shaped tube 620, and further enters the indoor unit through the first indoor-unit connection tube 30 to realize heating, and the refrigerant after heat exchange flows back to the outdoor unit through the second indoor-unit connection tube 50. When the multi-split air conditioner operates for refrigeration, the refrigerant flows through the second indoor-unit connection tube 50 to the indoor unit, then returns to the second U-shaped tube 630 through the second one-way solenoid valve 6120, and finally returns to the outdoor unit. The connection tubes (i.e. the first indoor-unit connection tubes 30 and the second indoor-unit connection tubes 50) connecting the entire solenoid valve assembly 60 with the indoor units may be arranged in a single layer or a multi-layer array according to the actual size of the switching device 100, thereby balancing the dimensional control between the length and the height of the switching device 100.

As shown in FIG. 1, one of the first U-shaped tube 620 and the second U-shaped tube 630 is disposed at an inner side of the other one of the first U-shaped tube 620 and the second U-shaped tube 630. Therefore, by arranging the first U-shaped tube 620 and the second U-shaped tube 630 inside and outside, it is convenient for the first U-shaped tube 620 and the second U-shaped tube 630 to be connected to the plurality of solenoid valve units 610, and the structure of the entire solenoid valve assembly 60 is more compact. The plurality of solenoid valve units 610 may be located inside the first U-shaped tube 620 and the second U-shaped tube 630, and disposed adjacent to curved portions of the first U-shaped tube 620 and the second U-shaped tube 630. The first one-way solenoid valves 6110 and the second one-way solenoid valves 6120 of the plurality of solenoid valve units 610 are respectively connected to tube walls of the first U-shaped tube 620 and the second U-shaped tube 630 through pipes.

Figure 7:
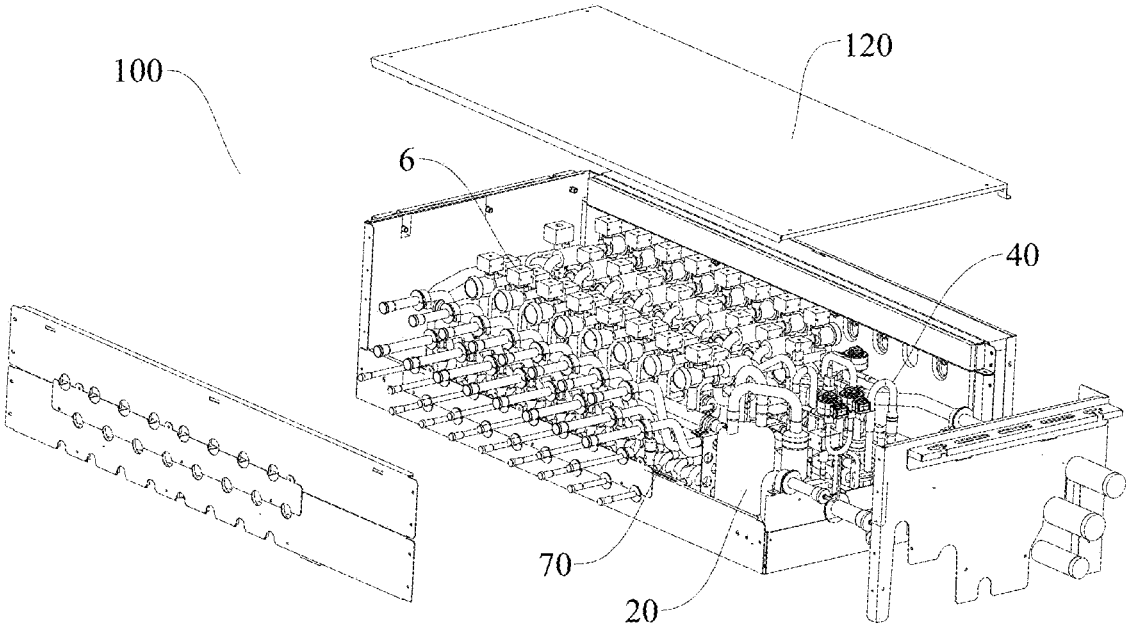
FIG. 7 is another exploded view of the switching device shown in FIG. 6.
Figure 8:
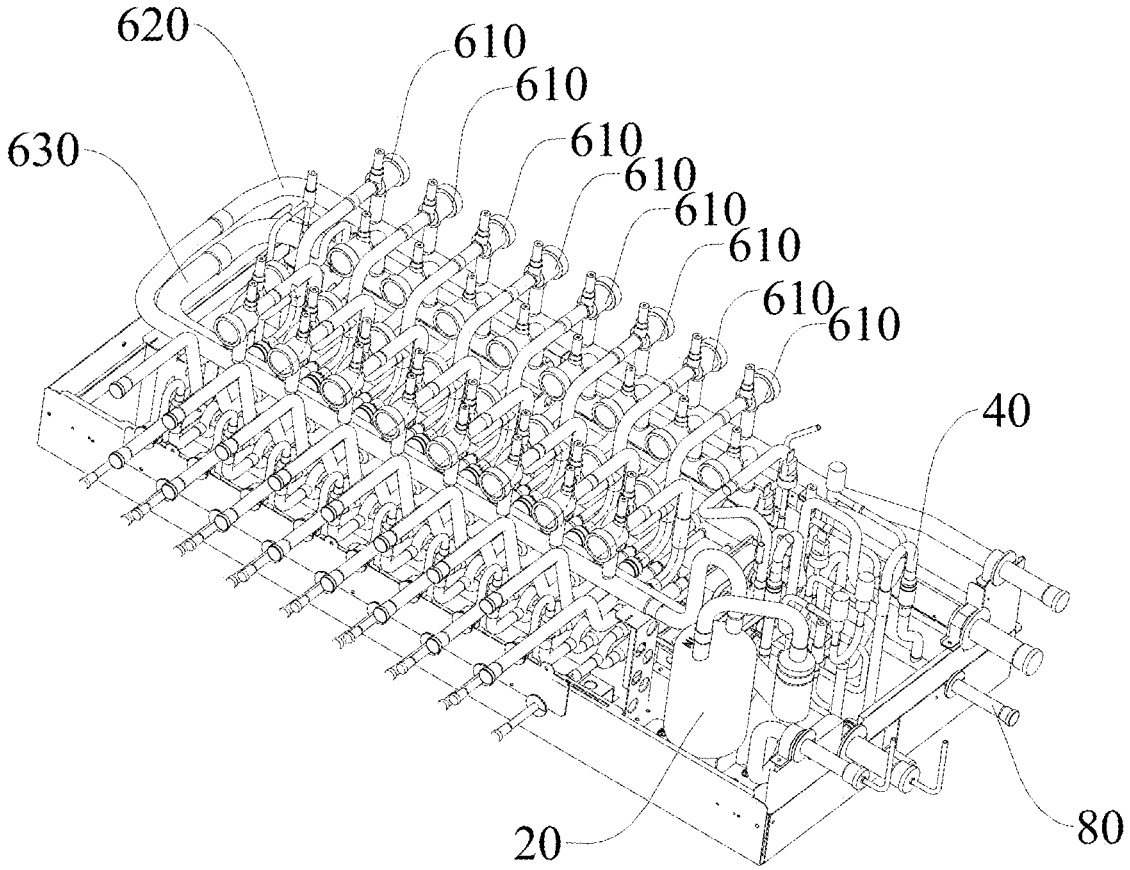
FIG. 8 is a schematic view showing the assembling of a base, a solenoid valve assembly, a check valve assembly, a gas-liquid separator and a heat exchange part shown in FIG. 7.

Alternatively, the heat exchange part 40 is disposed inside the first U-shaped tube 620 and the second U-shaped tube 630. As shown in FIGS. 6-8, the heat exchange part 40 is located between ends of the first U-shaped tube 620 and also between ends of the second U-shaped tube 630, so as to more fully and reasonably utilize the internal space of the housing 10.

One or more heat exchange parts 40 may be provided. For example, referring to FIG. 9, two heat exchange parts 40 are sequentially disposed downstream of the gas-liquid separator 20, so as to achieve better heat exchange and supercooling. When one heat exchange part 40 is provided, the heat exchange part 40 may be provided with a heat exchange portion on both sides thereof, and the refrigerant sequentially flows through the two heat exchange portions. In this case, the function of the heat exchange part 40 is substantially the same with that of the two heat exchange parts 40 shown in FIG. 9. Further, a throttling device 90 is disposed between the two heat exchange parts 40, and the throttling device 90 may be a capillary tube or an electronic expansion valve, but is not limited thereto.

According to a further embodiment of the present disclosure, as shown in FIG. 6, the switching device 100 for the multi-split air conditioner further includes a check valve assembly 70. The check valve assembly 70 is disposed below the solenoid valve assembly 60, and the check valve assembly 70 may be disposed between the solenoid valve assembly 60 and the drain tank 2. The check valve assembly 70 includes a plurality of check valve units extending in a horizontal direction and arranged side by side. Thereby, the height of the switching device 100 in the up and down direction can be effectively reduced by flattening the check valve assembly 70.

Specifically, each of the check valve units includes a first check valve 710 and a second check valve 720 configured to be arranged in parallel between the heat exchange part 40 and the second indoor-unit connection tube 50 for controlling different flow directions of heating and cooling of the multi-split air conditioner. The first check valve 710 is configured to guide the refrigerant in the heat exchange part 40 to the indoor unit unidirectionally, while the refrigerant in the indoor unit cannot enter the heat exchange part 40 through the first check valve 710. The second check valve 720 is configured to guide the refrigerant in the indoor unit to the heat exchange part 40 unidirectionally, while the refrigerant in the heat exchange part 40 cannot enter the indoor unit through the second check valve 720. The entire check valve assembly 70 can be connected during field installation. The connection tubes (i.e. the second indoor-unit connection tubes 50) connecting the entire check valve assembly 70 to the indoor unit may be arranged in a single layer or a multi-layer array according to the actual size of the switching device 100, thereby balancing the dimensional control between the length and height of the switching device 100.

In some embodiments, the first check valve 710 and the second check valve 720 are arranged in the up and down direction as shown in FIG. 6. Thereby, the size of the entire check valve assembly 70 in the length direction of the housing 10 can be reduced, thus making the entire structure of the switching device 100 more compact.

As shown in FIGS. 7-9, the pipe connected between the second check valve 720 and the heat exchange part 40 has an extension section 80 that extends out of the housing 10. An end of the first U-shaped tube 620 and an end of the second U-shaped tube 630 may respectively extend out of the housing 10. When the number of the indoor units to be connected is large, the above ends of the first U-shaped tubes 620, the above ends of the second U-shaped tubes 630, and the extension sections 80 of multiple switching devices 100 may be respectively connected together in one to one correspondence, thereby realizing the series connection of the multiple switching devices 100 and facilitating the expansion of the number of ports of the indoor units.

According to some embodiments of the present disclosure, as shown in FIG. 9, the gas-liquid separator 20 is configured to be disposed adjacent to the outdoor unit. In this case, the gas-liquid separator 20 is located in the housing 1 and at a side close to the outdoor unit, and the main function of the gas-liquid separator 20 is to separate the gas-liquid two-phase refrigerant entering from the outdoor unit, such that the gaseous refrigerant is discharged from the heating side, and the liquid refrigerant is discharged from the cooling side, thereby achieving better cooling and heating effects. The placement manner of the gas-liquid separator 20 is not limited to a vertical or horizontal type, as long as the gas-liquid separation function can be realized.

According to some specific embodiments of the present disclosure, as shown in FIGS. 6 and 7, the housing 10 has a substantially cuboid shape, and the first direction is the length direction of the housing 10 shown in FIG. 6. The gas-liquid separator 20, the heat exchange part 40, the solenoid valve assembly 60 and the check valve assembly 70 are all disposed in the housing 10, and the solenoid valve assembly 60 is arranged above the check valve assembly 70. The solenoid valve assembly 60 is preferably arranged direct above the check valve assembly 70 so as to further improve the compactness of the entire switching device 100. The solenoid valve assembly 60 and the check valve assembly 70 are disposed at one side (e.g. a left side in FIG. 6) in the length direction of the housing 10. In this case, the solenoid valve assembly 60 and the check valve assembly 70 may be adjacent to a left side wall of the housing 10, while the gas-liquid separator 20 and the heat exchange part 40 are disposed at the other side (e.g. a right side in FIG. 6) in the length direction of the housing 10, and the gas-liquid separator 20 and the heat exchange part 40 are arranged sequentially in the width direction of the housing 10. In this case, the gas-liquid separator 20 and the heat exchange part 40 may be adjacent to a right side wall of the housing 10. Therefore, by adopting the above arrangement, the structure of the entire switching device 100 is more compact and the space occupied by the switching device 100 is reduced, such that the application occasion and the installation position of the switching device 100 will not be affected.

According to some embodiments of the present disclosure, as shown in FIGS. 6 and 7, the housing 10 includes a top cover 120 removably disposed on the top of the housing 10 for ease of maintenance or the like. Alternatively, the housing 1 is a sheet metal member, but is not limited thereto.

Further, as shown in FIG. 6, an electric control box assembly 910 is disposed outside the housing 10. The electric control box assembly 910 is arranged vertically and disposed to a side surface of the housing 10. For example, the electric control box assembly 910 may be hung on the side surface of the housing 10, but is not limited to being fixed to any one side surface, as long as the entire electric control box assembly 910 can be fixed, such that the electric control box assembly 910 can implement the control function. The electric control box assembly 910 may be connected to an electric control component such as a solenoid valve or the like in the housing 10.

The switching device 100 for the multi-split air conditioner according to the embodiment of the present disclosure can realize separate control of cooling and heating of different indoor units. The main principle and realization method thereof are that the gas-liquid separator 20 separates the gas-liquid two-phase refrigerant such that the gaseous refrigerant flows out of the first outlet 220 and flows from the gas side to the corresponding indoor unit for heating, while the liquid refrigerant flows out of the second outlet 230 and flows from the liquid side to the corresponding indoor unit for cooling. Moreover, the separate control of different indoor units is realized by the reverse control of the corresponding solenoid valve assembly 60.

Specifically, as shown in FIG. 9, when a part of the plurality of indoor units operate for heating and another part of the plurality of indoor units operate for cooling, the first one-way solenoid valve 6110 corresponding to the indoor unit for heating is opened (in this case, the second one-way solenoid valve 6120 corresponding to the indoor unit for heating is closed) and the second one-way solenoid valve 6120 corresponding to the indoor unit for cooling is opened (in this case, the first one-way solenoid valve 6110 corresponding to the indoor unit for cooling is closed). The refrigerant in the outdoor unit first enters the gas-liquid separator 20 of the switching device 100 for gas-liquid separation, the separated gaseous refrigerant is discharged out of the first outlet 220, sequentially flows through the first U-shaped tube 620, the corresponding first one-way solenoid valve 6110 and the first indoor-unit connection tube 30, then enters the indoor unit for heating, and the refrigerant after heat exchange returns to the outdoor unit through the second indoor-unit connection tube 50, the second check valve 720 and the second U-shaped tube 630. Moreover, the separated liquid refrigerant is discharged out of the second outlet 230, sequentially flows through the heat exchange part 40, the throttling device 90, the heat exchange part 40, the first check valve 710 and the second indoor-unit connection tube 50, then enters the indoor unit for cooling, and the refrigerant after heat exchange returns to the outdoor unit through the first indoor-unit connection tube 30, the second one-way solenoid valve 6120 and the second U-shaped tube 630.

The switching device 100 for the multi-split air conditioner according to the embodiment of the present disclosure can effectively prevent the noise generated when the refrigerant flows through the heat exchange system from being propagated through the drain tank 2 to the base 1, thereby greatly reducing the noise of using the air conditioner, expanding the application occasions and installation positions of the air conditioner, improving the comfort of the air conditioner, and providing a simple structure, convenient assembling and a low processing cost. In addition, it is beneficial to increasing the number of indoor units that can be controlled by the outdoor unit of the entire multi-split air conditioner, reducing the splicing of multiple switching devices 100, and also, improving the efficiency of on-site installation. Meanwhile, the entire switching device 100 is hierarchical and modular, thus providing great convenience for on-site maintenance. In addition, the switching device 100 may be disposed outside the outdoor unit, thereby facilitating maintenance of the switching device 100 and various components in the outdoor unit.

A multi-split air conditioner according to a second aspect of embodiments of the present disclosure includes the switching device 100 for the multi-split air conditioner according to the above first aspect of embodiments of the present disclosure.

Other configurations and operations of the multi-split air conditioner according to the embodiment of the present disclosure are known to those skilled in the art and will not be described in detail herein.

Reference throughout this specification to "an embodiment," "some embodiments," "an illustrative embodiment,"

"an example," "a specific example," or "some examples," means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the changes, modifications, alternatives and varieties can be made in the embodiments without departing from the principles and objectives of the present disclosure. The scope of the present disclosure is limited by claims and their equivalents.

What is claimed is:

1. A switching device for a multi-split air conditioner, comprising:

a base having a bottom wall and a side wall, the side wall surrounding the bottom wall and extending upward from an edge of the bottom wall;

a drain tank disposed in the base and having a bottom surface spaced apart from the bottom wall of the base in an up and down direction, wherein the bottom wall of the base is provided with at least one support damping pad thereon, and the support damping pad is arranged between the bottom surface of the drain tank and the bottom wall of the base;

a plurality of damping pads disposed to the drain tank and arranged at intervals along a circumferential direction of the drain tank; and a plurality of fixing members disposed to the plurality of damping pads respectively, and connected to the side wall of the base, the plurality of fixing members being spaced apart from the drain tank, wherein the multi-split air conditioner comprises an outdoor unit and a plurality of indoor units having a plurality of first ports and a plurality of second ports, and the switching device further comprises:

a housing having an open bottom and arranged above the base;

a gas-liquid separator disposed in the housing, the gas-liquid separator having an inlet, a first outlet and a second outlet, the inlet being configured to be connected to the outdoor unit;

a plurality of first indoor-unit connection tubes spaced apart from one another in a first direction, the first outlet being connected to the plurality of first ports respectively via the plurality of first indoor-unit connection tubes;

at least one heat exchange part having an end connected to the second outlet;

a plurality of second indoor-unit connection tubes spaced apart from the plurality of first indoor-unit connection tubes in a second direction perpendicular to the first direction, the plurality of second indoor-unit connection tubes being spaced apart from one another in the first direction, the heat exchange part having another end connected to the plurality of second ports respectively via the plurality of second indoor-unit connection tubes, and part of the plurality of first indoor-unit connection tubes and the plurality of second indoor-unit connection tubes are spaced apart from the rest of the first indoor-unit connection tubes and the second indoor-unit connection tubes in the second direction, a solenoid valve assembly comprising a plurality of solenoid valve units arranged side by side, a first U-shaped tube and a second U-shaped tube, each solenoid valve unit comprising a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to guide a refrigerant in the first U-shaped tube into the corresponding first indoor-unit connection tube unidirectionally, the second one-way solenoid valve being configured to guide the refrigerant in the first indoor-unit connection tube into the outdoor unit unidirectionally, and one of the first U-shaped tube and the second U-shaped tube being disposed at an inner side of the other one of the first U-shaped tube and the second U-shaped tube; and a check valve assembly disposed below the solenoid valve assembly, the check valve assembly comprising a plurality of check valve units arranged side by side and extending in a horizontal direction, each check valve unit comprising a first check valve and a second check valve configured to be arranged in parallel between the heat exchange part and the second indoor-unit connection tube, the first check valve being configured to guide the refrigerant in the heat exchange part to the indoor unit unidirectionally, and the second check valve being configured to guide the refrigerant in the indoor unit to the heat exchange part unidirectionally.

2. The switching device for the multi-split air conditioner according to claim 1, wherein each damping pad has a clamping slot in a middle portion thereof, the clamping slot is configured as an annular slot extending along a circumferential direction of the damping pad, each fixing member further comprises:

an engaging part having a groove recessed from a side of the engaging part to a center of the engaging part, the middle portion where the clamping slot is formed entering into the groove through an opening of the groove and being fitted with a bottom of the groove; and a connecting part connected to a side of the engaging part adjacent to the side wall of the base and further connected to the side wall of the base.

3. The switching device for the multi-split air conditioner according to claim 1, wherein an upper surface of the support damping pad is provided with a blind hole recessed downwards, and the switching device further comprises:

a positioning screw penetrating through the bottom wall of the base and a bottom wall of the blind hole from the bottom up, so as to connect the support damping pad to the base.

4. The switching device for the multi-split air conditioner according to claim 1, wherein a sponge body is disposed to the bottom surface of the drain tank.

5. The switching device for the multi-split air conditioner according to claim 1, wherein an anti-vibration gum is disposed on the bottom wall of the base.

6. The switching device for the multi-split air conditioner according to claim 1, wherein:

the housing has a substantially cuboid shape, the first direction is a length direction of the housing;

the heat exchange part, the solenoid valve assembly and the check valve assembly are all disposed in the housing, the solenoid valve assembly is arranged above the check valve assembly, the solenoid valve assembly and the check valve assembly are disposed at one side in the length direction of the housing, while the gas-liquid separator and the heat exchange part are disposed at the other side in the length direction of the housing, and the gas-liquid separator and the heat exchange part are arranged sequentially in a width direction of the housing; and an electric control box assembly is disposed outside the housing, the electric control box assembly is arranged vertically and disposed to a side surface of the housing.

7. A multi-split air conditioner, comprising:

a switching device;

a plurality of indoor units having a plurality of first ports and a plurality of second ports; and an outdoor unit, wherein the outdoor unit is connected to the plurality of indoor units through the switching device and the switching device further includes:

a base having a bottom wall and a side wall, the side wall surrounding the bottom wall and extending upward from an edge of the bottom wall;

a drain tank disposed in the base and having a bottom surface spaced apart from the bottom wall of the base in an up and down direction, wherein the bottom wall of the base is provided with at least one support damping pad thereon, and the support damping pad is arranged between the bottom surface of the drain tank and the bottom wall of the base;

a plurality of damping pads disposed to the drain tank and arranged at intervals along a circumferential direction of the drain tank; and a plurality of fixing members disposed to the plurality of damping pads respectively, and connected to the side wall of the base, the plurality of fixing members being spaced apart from the drain tank, wherein the switching device further comprises:

a housing having an open bottom and arranged above the base;

a gas-liquid separator disposed in the housing, the gas-liquid separator having an inlet, a first outlet and a second outlet, the inlet being configured to be connected to the outdoor unit;

a plurality of first indoor-unit connection tubes spaced apart from one another in a first direction, the first outlet being connected to the plurality of first ports respectively via the plurality of first indoor-unit connection tubes;

at least one heat exchange part having an end connected to the second outlet;

a plurality of second indoor-unit connection tubes spaced apart from the plurality of first indoor-unit connection tubes in a second direction perpendicular to the first direction, the plurality of second indoor-unit connection tubes being spaced apart from one another in the first direction, the heat exchange part having another end connected to the plurality of second ports respectively via the plurality of second indoor-unit connection tubes, and part of the plurality of first indoor-unit connection tubes and the plurality of second indoor-unit connection tubes are spaced apart from the rest of the first indoor-unit connection tubes and the second indoor-unit connection tubes in the second direction, a solenoid valve assembly comprising a plurality of solenoid valve units arranged side by side, a first U-shaped tube and a second U-shaped tube, each solenoid valve unit comprising a first one-way solenoid valve and a second one-way solenoid valve, the first U-shaped tube being connected to the first outlet and further connected to the plurality of first indoor-unit connection tubes respectively via the plurality of first one-way solenoid valves, the plurality of first indoor-unit connection tubes being configured to be connected to the outdoor unit respectively via the plurality of second one-way solenoid valves, the first one-way solenoid valve being configured to guide a refrigerant in the first U-shaped tube into the corresponding first indoor-unit connection tube unidirectionally, the second one-way solenoid valve being configured to guide the refrigerant in the first indoor-unit connection tube into the outdoor unit unidirectionally, and one of the first U-shaped tube and the second U-shaped tube being disposed at an inner side of the other one of the first U-shaped tube and the second U-shaped tube; and a check valve assembly disposed below the solenoid valve assembly, the check valve assembly comprising a plurality of check valve units arranged side by side and extending in a horizontal direction, each check valve unit comprising a first check valve and a second check valve configured to be arranged in parallel between the heat exchange part and the second indoor-unit connection tube, the first check valve being configured to guide the refrigerant in the heat exchange part to the indoor unit unidirectionally, and the second check valve being configured to guide the refrigerant in the indoor unit to the heat exchange part unidirectionally.

8. The multi-split air conditioner according to claim 7, wherein each damping pad has a clamping slot in a middle portion thereof, the clamping slot is configured as an annular slot extending along a circumferential direction of the damping pad, each fixing member further comprises:

an engaging part having a groove recessed from a side of the engaging part to a center of the engaging part, the middle portion where the clamping slot is formed entering into the groove through an opening of the groove and being fitted with a bottom of the groove; and a connecting part connected to a side of the engaging part adjacent to the side wall of the base and further connected to the side wall of the base.

9. The multi-split air conditioner according to claim 7, wherein an upper surface of the support damping pad is provided with a blind hole recessed downwards, and the switching device further comprises:

a positioning screw penetrating through the bottom wall of the base and a bottom wall of the blind hole from the bottom up, so as to connect the support damping pad to the base.

10. The multi-split air conditioner according to claim 7, wherein a sponge body is disposed to the bottom surface of the drain tank.

11. The multi-split air conditioner according to claim 7, wherein an anti-vibration gum is disposed on the bottom wall of the base.

12. The multi-split air conditioner according to claim 7, wherein:

the housing has a substantially cuboid shape, the first direction is a length direction of the housing;

the heat exchange part, the solenoid valve assembly and the check valve assembly are all disposed in the housing, the solenoid valve assembly is arranged above the check valve assembly, the solenoid valve assembly and the check valve assembly are disposed at one side in the length direction of the housing, while the gas-liquid separator and the heat exchange part are disposed at the other side in the length direction of the housing, and the gas-liquid separator and the heat exchange part are arranged sequentially in a width direction of the housing; and an electric control box assembly is disposed outside the housing, the electric control box assembly is arranged vertically and disposed to a side surface of the housing.

* * * * *